United States Patent [19]

Antonious

[11] Patent Number: 4,709,814

[45] Date of Patent: Dec. 1, 1987

[54] ROTATABLE CLUB HOLDER INSERT FOR A GOLF BAG

[76] Inventor: Anthony J. Antonious, 205 East Joppa Rd., Unit 1603, Towson, Md. 21204

[21] Appl. No.: 942,675

[22] Filed: Dec. 17, 1986

[51] Int. Cl.[4] ..... A63B 55/00

[52] U.S. Cl. ..... 206/315.3; 248/96; 211/70.2; 280/DIG. 6; 206/315.6

[58] Field of Search ..... 248/96; 280/DIG. 6; 206/315.2, 315.3, 315.4, 315.5, 315.6, 315.7, 315.8; 211/70.2

[56] References Cited

U.S. PATENT DOCUMENTS 4,111,248 9/1978 Weichhardt ..... 206/315.6

*Primary Examiner*—William Price

*Attorney, Agent, or Firm*—Finnegan, Henderson, Farabow, Garrett & Dunner

[57] ABSTRACT

A rotatable golf club holder insert adapted to be inserted in a golf bag and a golf bag having such an insert preferably including a series of golf club dividers forming separated compartments to receive the golf clubs and coupling means associated with the golf bag for permitting the club holder insert to be rotated in a 360 degree manner in either direction so that the insert may be rotatably relocated to an optimum frontal position relative to a golfer so that the golfer can easily withdraw or replace a club from or in the bag.

39 Claims, 18 Drawing Figures

ROTATABLE CLUB HOLDER INSERT FOR A GOLF BAG

BACKGROUND OF THE INVENTION

The present invention relates to golf bags, and more particularly to a golf bag having a rotatable club holder insert whereby any of the golf clubs carried by the bag are more easily accessible regardless where the desired club is located in the bag.

Golf bags have been traditionally made in various sizes for carrying golf clubs and include a generally cylindrical bag member and a strap adapted to be carried on the shoulder of a user. The bag normally is provided with a series of dividers to separate a set of golf clubs which number up to fourteen clubs when a complete set is used. Golf bags of these types are shown in U.S. Pat. Nos. 4,311,178 to Kennedy; 4,245,684 to Street; 3,729,036 to McFadden; 3,331,419 to Beuchviscutto; 3,139,132 to Shiller; 3,053,298 to Stamp; and 2,860,679 to Louks, among others.

With bags of these types, often a golfer, when removing a club, will find it behind or entangled with other clubs making extraction a difficult process. Also, when replacing clubs, a golfer often will find little room for the club where it would normally be placed. Forcing the clubs into the bag sometimes causes damage to club grips and may even bend a club shaft. Also, it may cause the golfer frustration which would effect his performance. This is particularly true when a golf bag is strapped firmly on a golf cart, either of the hand pull type or a power cart, since the bag is not moveable relative to the cart.

The present invention relates to a rotatable golf club holder insert which may be formed integrally with a golf bag or which may be added as a conversion insert to conventional golf bags. The insert is mounted for free rotational movement within the bag and about the bag's longitudinal axis to enable the user to easily and freely remove or replace any particular club from any location in the bag, regardless of whether the bag is free-standing, carried on a shoulder, secured to a cart, or in any other position such as in a closet or trunk of a car where access would be limited. The club holder insert of the present invention is designed with a plurality of dividers to enable the golf clubs to be separated into various slots or compartments. The club holder insert is mounted within the outer shell of the golf bag so as to be freely rotatable a full 360 degrees in either direction to provide easy access to the various locations where clubs are held within the bag. This access allows a golfer to easily withdraw a club from or replace a club in the golf bag.

Conversion of a conventional golf bag to a rotatable type merely requires removing the strap and dividers from the bag opening of a conventional golf bag and inserting a rotatable insert, along with an attachment assembly, therein. The insert is connected to the conventional bag through an attachment assembly that is fixed to the bag by a suitable attaching means, such as screws, rivets, bolts etc.

Among the objectives of the present invention are the provision of a golf bag wherein access to golf clubs carried within the bag is greatly facilitated; the provision of a golf bag wherein any golf club carried within the bag may be easily accessed thereby minimizing damage to golf club grips when they are replaced or removed from the bag; the provision of a golf bag wherein any particular golf club may be rotated to an optimum frontal access position relative to a user notwithstanding the location of the golf bag or the position of the particular golf club within the golf bag.

These and other objectives of the present invention will become more apparent from the following description of the preferred embodiments of the invention and the appended drawings related thereto.

DESCRIPTION OF THE PREFERRED EMBODIMENTS

Figure 3:
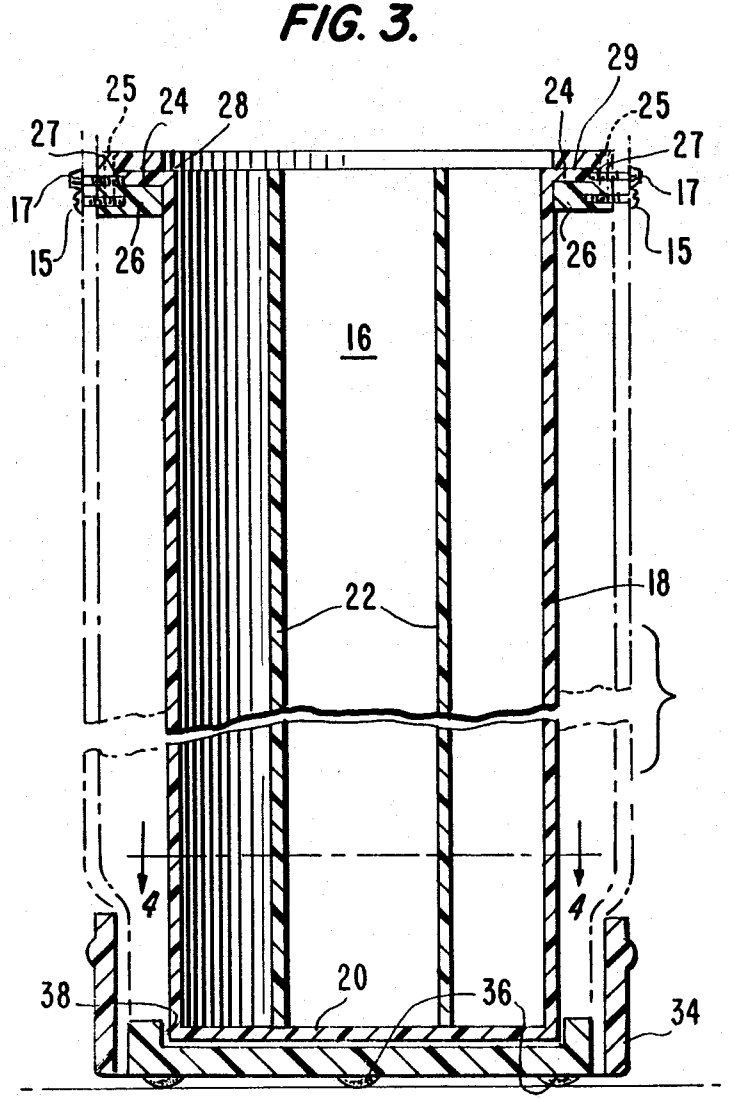
FIG. 3 is a sectional view showing a longitudinal cross section of the bag and insert shown in FIG. 2.
Figure 2:
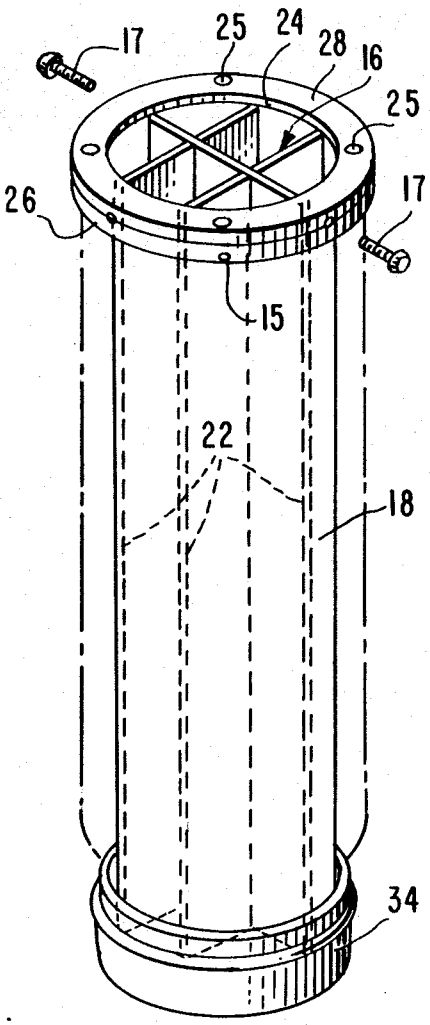
FIG. 2 is a perspective view of a portion of a rotatable insert adopted for mounting in the golf bag of FIG. 1.
Figure 1:
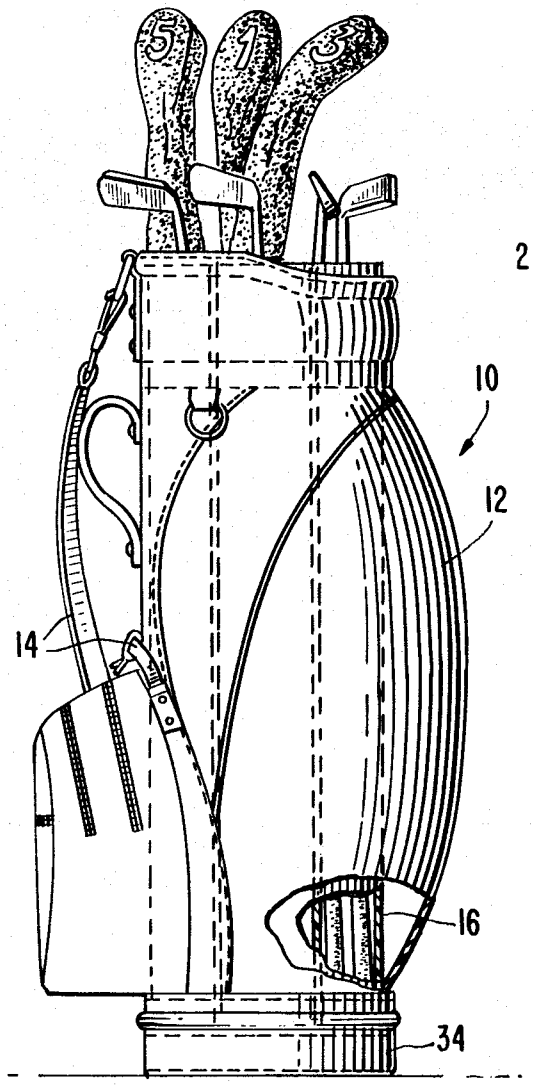
FIG. 1 shows an elevational view, partially in section, of a golf bag of the present invention including a number of golf clubs carried therein.
Figure 4:
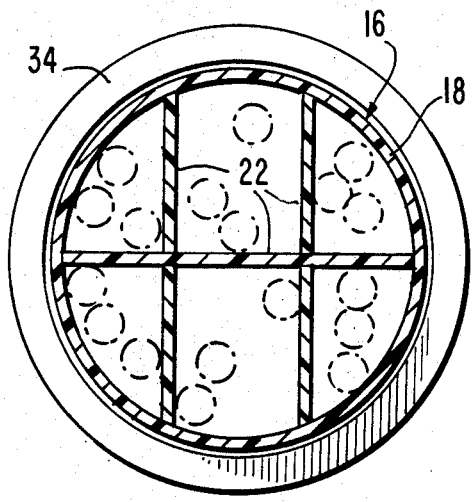
FIG. 4 is a cross sectional view taken along the lines 4—4 of FIG. 3.

FIGS. 1 through 4 illustrate one embodiment of the golf bag 10 of the present invention. FIG. 1 illustrates the bag holding a plurality of golf clubs, shown partly in section. The bag includes an outer shell or casing 12, suitable carrying straps 14 and a rotatable club holder insert 16 shown in detail in FIGS. 2, 3 and 4. In a preferred embodiment, the insert 16 is formed of a cylindrical body 18, a bottom 20, and longitudinal dividers 22 which form separate compartments within the insert which are adapted to contain and separate the golf clubs carried in the bag. The upper end of the club holder insert 16 is provided with an annular flange 24. The mounting structure for mounting the insert 16 in the golf bag 10 includes an annular supporting collar 26 having a shoulder which is mounted on the inside of the golf bag shell with suitable fastener means. The mounting assembly further includes an L-shaped retaining collar 28 which in combination with supporting collar 26 retains flange 24 of insert 16. As shown in FIG. 3, the retaining collar 28 and the supporting collar 26 are held together by screws 25 or by other suitable attachment means, such as glue, epoxy, rivets, or the like. When the collars are so assembled, the insert 16 and collars 26 and 28 form a prefabricated unit which can be readily inserted into a golf bag. The prefabricated unit can then be fixed to the golf bag by a variety of conventional attachment means. By way of example, as shown in FIG. 3, suitable mounting bolts 15 pass through the frame of the bag and screw into supporting collar 26 to thereby secure the collars and insert to the bag. When so secured, the flange 24 of the cylindrical body 18 of insert 16 is maintained in place while permitting rotatable movement between the supporting and retaining collar members and the insert 16. As seen in FIG. 3, the annular flange 24 of the club holder insert 16 rests on the annular collar 26. Since the collars and flange of the club holder insert may be made of relatively frictionless metal or plastic material such as Teflon, Nylon, or similar material, the club holder insert 16 is free to rotate within the interior of the golf bag 10.

The golf bag includes a base 34 which is adapted to support the bag on a ground surface and includes conventional type support stubs 36. The base 34 includes a well 38 which is adapted to receive the bottom 20 of the club holder insert 16 and locate the club holder insert 16 centrally within the golf bag 10 while still permitting rotational movement of the club holder insert 16 as described hereinbelow.

While the insert 16 can freely rotate about its longitudinal axis, which preferably coincides with the longitudinal axis of the bag, the insert is firmly held in position within the bag. As shown, the outer cylindrical wall of the top of the insert 16 interfaces with the cylindrical side walls of the supporting collar 26. Similarly, the outer cylindrical wall of the bottom of the insert 16 interfaces with the cylindrical wall of well 38. As a result, the insert is held in a central position within the bag and is restrained from lateral movement. In addition, the annular flange 24 and the retaining collar 28 cooperate to restrain the flange 24 and insert 16 from moving in a longitudinal directional into or out of the bag.

In use, the club holder insert 16 may be rotated by simply grasping the top portion and rotating it. Gripping the golf clubs and rotating them would serve the same purpose. In a preferred embodiment, the insert 16, annular flange 24, supporting collar 26, and well 38 are sized so that there is sufficient friction between the insert 16 and its supporting members so that insert 16 will rotate only when the golfer applies such an additional force to the insert. This friction force achieved through close tolerances will restrain the insert from free-wheeling rotation when the bag is merely picked up or moved. As shown in FIG. 3, an additional means, such as friction screw or screws 17, can be added for restraining insert 16 from unwanted rotation. In this embodiment friction screw 17 is aligned with the annular flange 24 of insert 16. The friction screw 17 can be adjusted through rotation to vary the pressure against flange 24 and thereby selectively vary the force needed to rotate the insert. Other means, such as one or more pins and associated detents, could also be used.

As indicated above, the rotatable insert may be provided as part of an original equipment golf bag structure or it may be used to convert a conventional golf bag by removing the original equipment dividers and holding strap and replacing them with the insert of this invention, along with a suitable mounting collar and associated hardware. For example, the insert 16, supporting collar 26, and retaining collar 28 shown in FIGS. 1–3 could be added to a conventional bag. It will also be appreciated that the various rotatable club holder inserts shown and described hereinbelow may be used either in original equipment golf bags or for conversion of conventional golf bags to the rotatable type.

Figure 5:
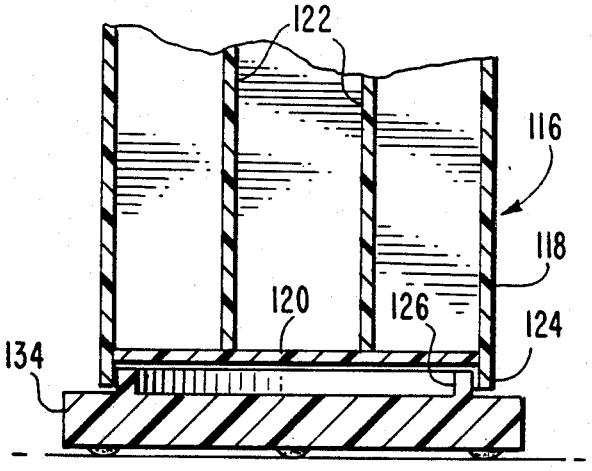
FIG. 5 is a partial sectional view of the bottom of a rotatable insert showing an alternate embodiment of the invention.

FIGS. 5 through 18 shown various other embodiments of the golf bag and rotatable insert structures. FIG. 5 illustrates an alternate embodiment of a club holder insert 116 of the present invention including a cylindrical wall 118, dividers 122 and a bottom 120. In this embodiment, the club holder insert includes an annular flange 124 projecting downwardly which cooperates with a corresponding upwardly projecting annular flange 126 of the base 134 of the golf bag. The flanges 124 and 126 form a telescopic connection in order to locate the club holder insert 116 within the bag. The flanges cooperate to centrally locate the insert and restrain it from lateral movement, and this arrangement can be used as an alternative to the wall and well arrangement shown in FIG. 3.

Figure 6:
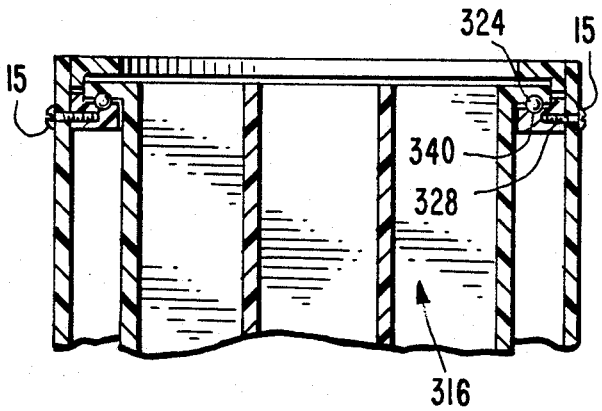
FIG. 6 is a partial sectional view of the top of a rotatable insert showing an alternative embodiment of the present invention including bearings.

FIG. 6 shows a detail of still another embodiment of an club holder insert 316 which is similar to the embodiment shown in FIG. 3. In this embodiment, however, ball bearings 340 are positioned in a track (not shown) between the underside of the upper flange 324 and the lower L-shaped collar 328 which can be fixed to a golf bag. The ball bearings 340 provide smoother rotatability of the club holder insert with respect to the collar. Again, the insert, upper and lower L-shaped collars, and the bearings can be prefabricated and marketed as a unit assembly.

Figure 7:
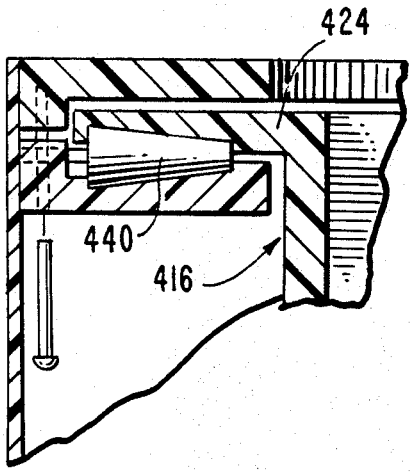
FIG. 7 is a partial sectional view of the top of a rotatable insert showing a further embodiment of the present invention including rollers.

FIG. 7 shows still another embodiment of a detail of a club holder insert 416 similar to that described with respect to FIG. 6 wherein a plurality of spaced conical rollers 440 (only one being shown) are used between the flange 424 and the collar 428. The flange 424 and collar 428 are fixed to a bag, and the conical rollers 440 allow smooth rotation of the insert about the longitudinal axis of the bag.

Figure 8:
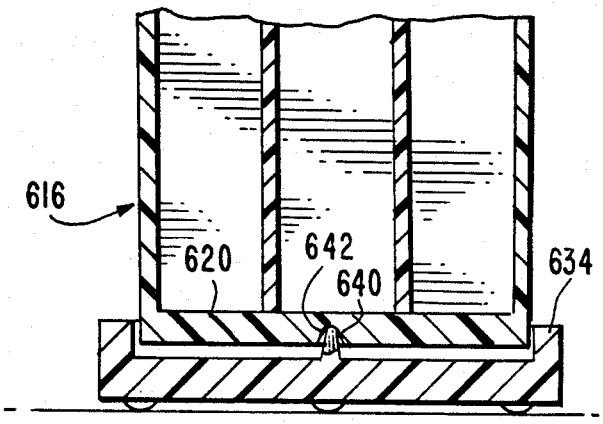
FIG. 8 is a partial sectional view of a rotary bottom support for a rotary insert showing a further embodiment of the present invention.

FIG. 8 shows yet another embodiment of a club holder insert 616 having a bottom 620 provided with a socket 642. The base 634 of the golf bag is provided with a pin 640 which is received within the insert socket 642. The pin and socket cooperate to locate and laterally restrain the insert. This embodiment can be used with the various top assemblies shown in FIGS. 1, 6, 7 and 11.

Figure 10:
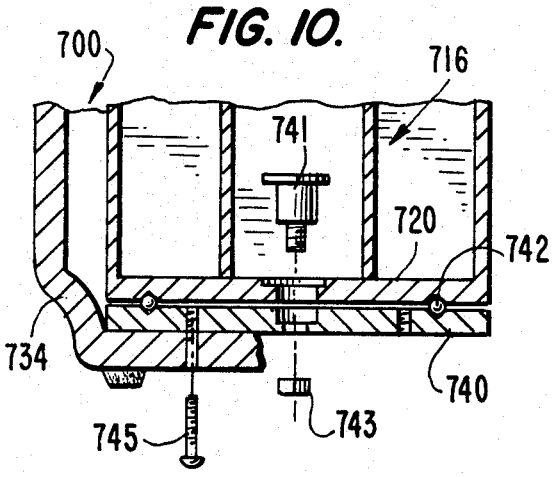
FIG. 10 is an exploded view of the bottom of the insert shown in FIG. 9.
Figure 9:
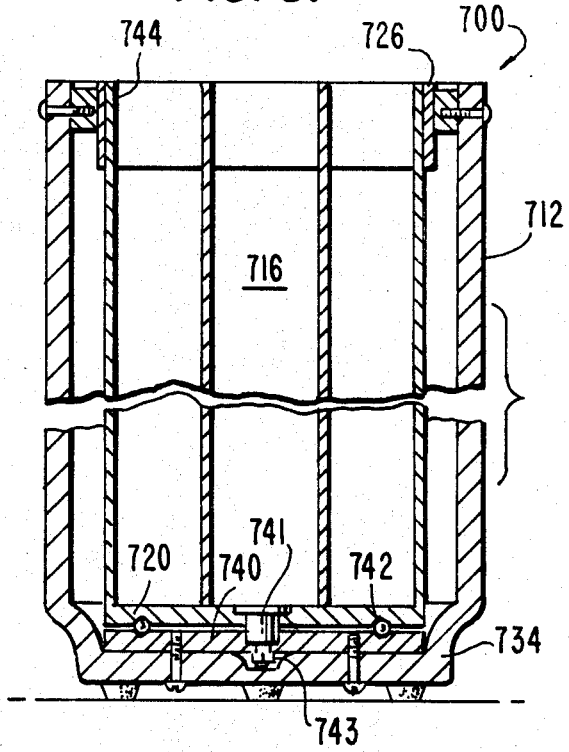
FIG. 9 is a sectional view of a golf bag illustrating a further embodiment of the present invention where the bottom of the insert includes a ball bearing support.

FIGS. 9 and 10 show yet another embodiment of a golf bag 700 and a club holder insert 716 wherein the bottom 720 of the insert rests on a plate 740 which is suitably attached to the base 734 of the golf bag 700. In this embodiment a plurality of ball bearings 742 ride between the bottom 720 of the insert and the plate 740 and thereby permit relative rotation between the club holder insert 716 and the bag 700. The bottom 720 of the insert, the ball bearings 742, and the plate 740 are held together as a unit by bolt 741 and nut 743. As shown in FIG. 10, the bolt 741 is preferable inserted through a recessed bore in the bottom 720 of the insert and a bore in plate 740. The nut 743 and bolt 741, when assembled together, hold the bottom 720, plate 740, and bearings 742 as a unit. The assembly of the insert, ball bearings, and plate can then be fixed to the bottom of the bag by suitable means, such as screws 745. It will be apparent that this arrangement will restrain the insert from moving into or out of the bag and will also restrain the lateral movement of the bottom of the insert. The upper edge 744 of the club holder insert 716 fits within an annular collar 726 suitably mounted within the outer shell 712 of the bag. The annular collar locates the insert within the center of the bag and keeps it in position. The collar 726 also preferably snugly fits against the side of the insert to provide a slight friction force.

Figure 11:
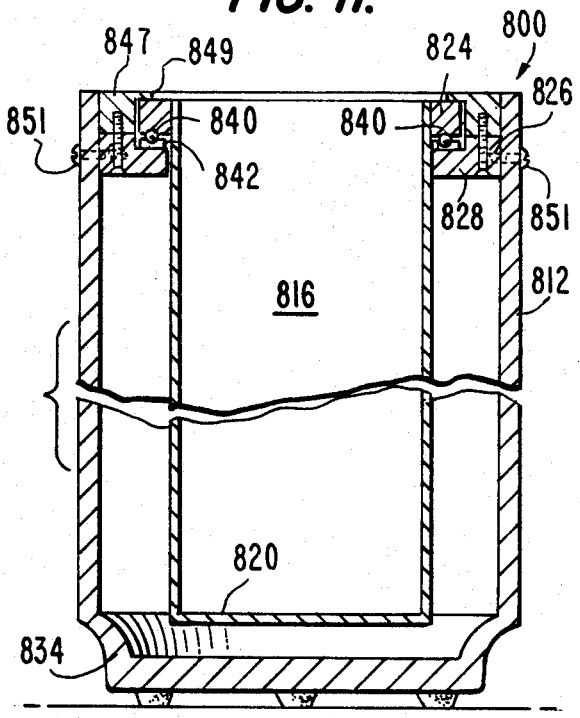
FIG. 11 is a sectional view of still another embodiment of the present invention wherein the upper portion of the insert includes ball bearings and the insert is suspended from the bag.

FIG. 11 illustrates another embodiment of the golf bag 800 of the present invention including an outer shell 812 and a club holder insert 816. The bottom 820 of the club holder insert 816 is suspended above the base 834 of the bag 800. The insert 816 includes an annular flange 824 which cooperates with a series of ball bearings 840 mounted on an annular ring 842 which in turn is supported on a shoulder 828 of a collar 826. As shown, collar 826 is secured to a complimentary annular collar 847 which includes a lip 849. The collars 826 and 847, the plate 842, the ball bearings 840, and the insert 816 are preferably prefabricated so that the insert 816 and its annular flange 824 are rotatably held in place relative to the collars. The collars then restrain the insert 816 from longitudinal and lateral movement but still allow rotation. In the embodiment, the ball bearings 840 permit free rotation between the club holder insert 816 and the outer shell 812. The inner wall of collar 826 cooperates with the outer, cylindrical wall of insert 816 to centrally locate the insert and hold it in position. Flange 824 also cooperates with lip 849 of collar 847 and with shoulder 82 of collar 826 to hold the flange and insert in position vertically. The prefabricated assembly can then be fixed to golf bag 800 by conventional means, such as screws 851. Preferably, the screws 851 are screwed into annular collar 826, since that collar provides vertical support of the insert. If desired, the bottom of insert 816 can be further stabilized by any of the assemblies shown in FIGS. 3, 5, 8 or 9, or by similar stabilizing means.

FIGS. 12 through 18 illustrate alternate embodiments of inserts which are adapted for use with the golf bag of the present invention. In these embodiments, the top mounting collars are shown in a simplified manner as an annular member. It will be appreciated that any of the mounting structures described hereinabove are equally applicable to any of the embodiments shown in these figures and have not been described in detail in the interest of simplicity.

Figure 12:
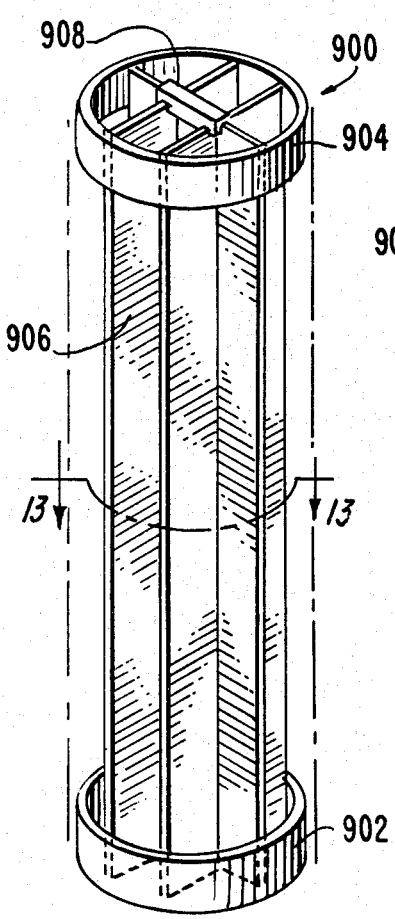
FIG. 12 is a perspective view of an alternate insert of the present invention.
Figure 13:
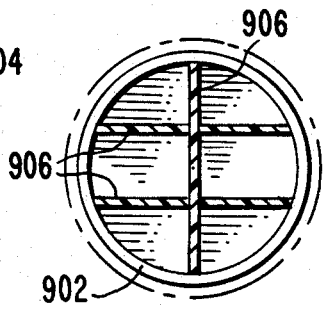
FIG. 13 is a sectional view taken along the lines 13—13 of FIG. 12.

FIGS. 12 and 13 illustrate an insert 900 of the present invention. The insert 900 includes a base 902, a top collar 904, and a series of dividers 906 which extend longitudinally between the base 902 and the top collar 904 forming six separate compartments adapted to receive golf clubs as best shown in the sectional view of FIG. 13. This embodiment does not include any outside cylindrical walls but instead includes exposed, fin-like dividers. The dividers 906 are strengthened and further supported by means of a cap 908. The dividers are formed of sufficiently rigid material such as high impact plastic or the like in order that the insert be self-standing when placed within the outer shell of a conventional golf bag as described with respect to the embodiments hereinabove.

Figure 15:
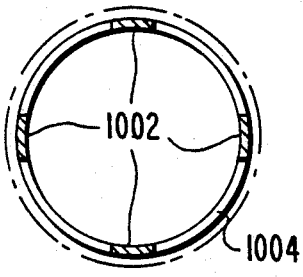
FIG. 15 is a sectional view taken along the lines 15—15 of FIG. 14.
Figure 14:
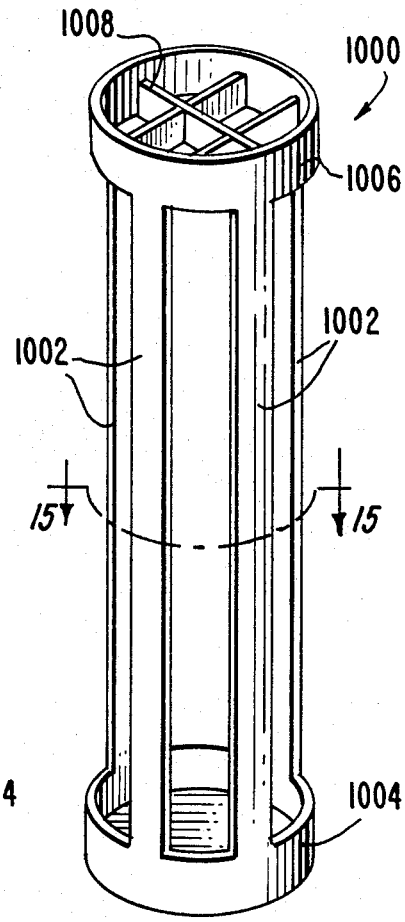
FIG. 14 is a perspective view of still another embodiment of an insert of the present invention.

FIGS. 14 and 15 show another embodiment of an insert 1000 formed of a series of vertical supports 1002 which connect a base 1004 with a top collar 1006. Both the base 1004 and the top collar 1006 may be integrally formed with the supports 1002 or may be joined by conventional techniques. The insert 1000 further includes an upper divider 1008 which is molded as an integral part or suitably fastened to the top collar 1006 by glue or other conventional methods. This arrangement provides a lightweight structure since the supports 1002 form only a minimal part of the insert as shown in the sectional view of FIG. 15 and eliminate the need for a cylindrical body like that shown in FIG. 3. Of course, it will be appreciated that the insert is made of sufficiently rigid material so that it is self-standing when placed within the outer shell of a golf bag as described hereinabove.

Figure 16:
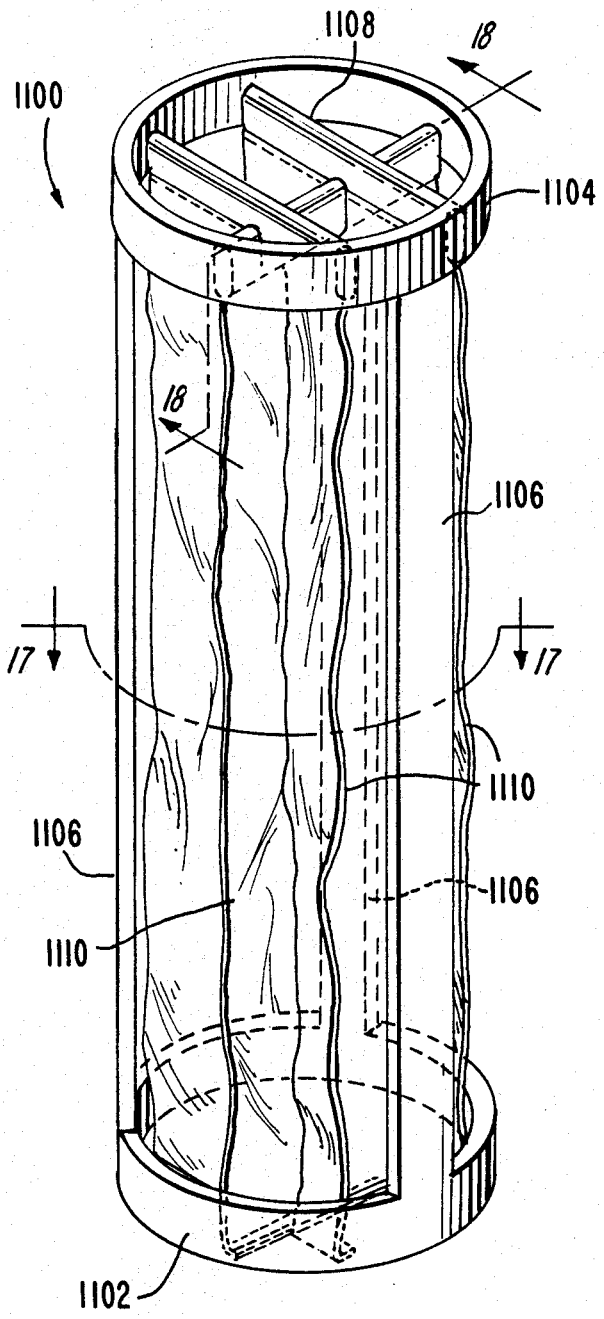
FIG. 16 is a partial perspective view of yet another insert formed in accordance with the present invention and having flexible dividers.
Figure 17:
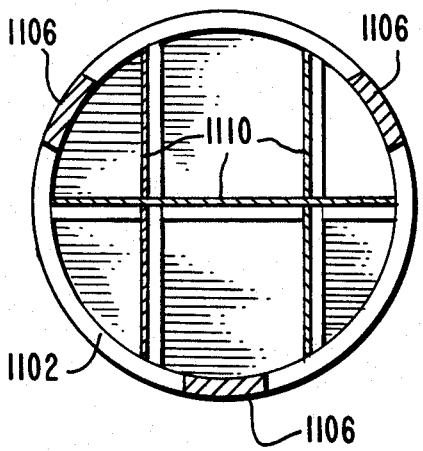
FIG. 17 is a sectional view taken along the lines 17—17 of FIG. 16.
Figure 18:
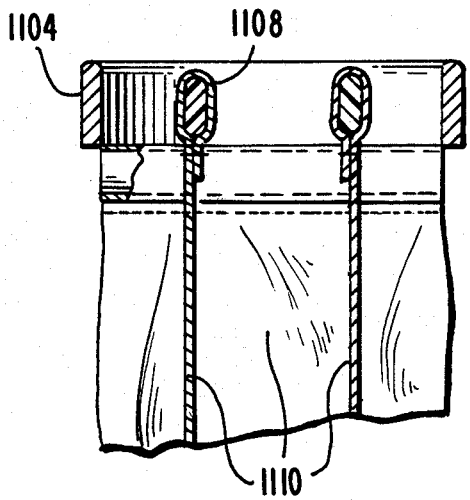
FIG. 18 is a partial sectional view taken along the lines 8—18 of FIG. 16.

FIGS. 16, 17 and 18 show another embodiment of an insert 1100 formed with a base 1102, a top collar 1104, and a series of vertical, outer supports 1106 which are sufficiently rigid so that the insert is self-standing when placed in a golf bag. The insert includes upper divider members 1108 which are suitably fastened to the collar 1104 by glue or other conventional means. As shown in the sectional views 17 and 18, the insert further includes longitudinal flexible dividers 1110 which are suitably connected to the top dividers 1108 and which are free to hang down in a longitudinal direction within the insert 1100 in order to provide flexible dividers for the golf clubs inserted therein. These flexible dividers may be formed of a variety of materials, such as canvas, leather, plastic and similar materials. This arrangement provides a lightweight insert having full length flexible dividers without the necessity of longitudinal rigid divider material.

In all the above-listed embodiments, it will be appreciated that the club holder insert is freely rotatable with respect to the outer shell of the golf bag. The club holder insert is also held in position within the bag so that the longitudinal axis of the insert and the bag coincide. Thus, when a bag is being held on someone's shoulder, or in a golf cart, or sits on a ground surface, it is a relatively easy task to independently rotate the club holder insert about its axis to the optimum frontal position in order that a particular golf club may be made easily accessible to the user regardless of its position in the bag. When so rotated, the top and bottom of the insert are preferably restrained from lateral movement to the sides or from longitudinal movement up and down.

As indicated above, the various inserts may be made in combination with the golf bag shell and carrying means or they may be adapted for use with conventional golf bags by adding the insert along with one or more embodiments of the mounting hardware disclosed in this application. All golf bags and inserts also should preferably include drain holes or openings in their respective bottoms to permit drainage.

The various mounting structures of the inserts illustrated in the present invention may include a brake member or other suitable stop mechanism such as a ball and detent arrangement in order that the insert be restrained or prevented from independent movement once it has reached a desired location. When such an arrangement is used, it would be merely necessary to release the stop mechanism in order that the insert be rotated to another position.

Other modifications of the structure may be made. For example, the club holder insert may be provided with a handle or vertical flange on the upper surface of club holder insert to aid in the rotation thereof. Various types of dividers forming different numbers of compartments may be used in the insert without departing from the scope of the present invention. For example, the dividers need not extend the entire length of the club holder insert, and they may be of various and different shapes. Other mechanical structures and hardware which permit relative rotation between the club holder insert and the outer shell of the bag may also be used without departing from the scope of the present invention which is defined in the following claims.

Other embodiments of the invention will be apparent to the skilled in the art from consideration of the specification and practice of the invention disclosed herein. It is intended that the specification and examples be considered as exemplary only, with a true scope in spirit of the invention being indicated by the following claims:

What is claimed is:

1. A golf bag for receiving and carrying a plurality of golf clubs, the golf bag comprising:

an elongated outer shell;

an elongated insert for receiving and holding a plurality of golf clubs, said insert being positioned within said outer shell; and connector means for interconnecting said insert with said outer shell in a manner which permits said insert to rotate about its longitudinal axis relative to said outer shell, whereby the user of the golf bag can selectively rotate the insert so that he can easily withdraw a club from or place a club into said insert, said connector means including an annular support member included on said outer shell and an annular mounting flange included on said insert, said mounting flange cooperating with and being rotatably supported on said support member.

2. The golf club bag of claim 1 wherein said connector means includes means for restraining said insert from moving laterally relative to said outer shell.

3. The golf club bag of claim 1 wherein said connector means includes means for restraining said insert from moving in a longitudinal direction into or out of said outer shell.

4. The golf club bag of claim 1 wherein said connector means includes means for restraining said insert from moving laterally relative to said outer shell and means for restraining said insert from moving in a longitudinal direction into or out of said outer shell.

5. The golf club bag of claims 1 or 4 wherein said insert and said outer shell are both substantially cylindrical in shape and wherein the longitudinal axis of said insert and said outer shell substantially coincide.

6. The golf club bag of claims 1 or 4 wherein said insert further includes divider means forming a plurality of golf club compartments within said insert.

7. The golf bag of claim 1 wherein said connector means further includes a retaining collar for retaining said mounting flange of said insert on said support member of said outer shell and for cooperating with said mounting flange and said support member to restrain said insert from moving in a longitudinal direction into or out of said outer shell.

8. The golf bag of claim 7 wherein said annular support member further includes an annular shoulder for restraining said insert from moving laterally relative to said outer shell.

9. The golf bag of claims 1 or 8 wherein said outer shell includes a base for supporting said golf bag on a ground surface, said base having locating means for positioning the bottom of said insert and for restraining the bottom of said insert from moving laterally relative to said base.

10. The golf bag of claim 9 wherein said base locating means is a well which receives the bottom of said insert.

11. The golf bag of claim 9 wherein said locating means includes a pin formed in one of said base and insert and a cooperating socket formed in the other of said base and insert.

12. The golf bag of claim 9 wherein said insert includes a downwardly projecting flange and wherein said base locating means includes an upright annular flange which cooperates with said downwardly projecting flange.

13. The golf bag of claim 7 wherein said support member and said retaining collar cooperate to form a slot which receives said mounting flange on said insert.

14. The golf bag of claim 1 wherein said connector means further includes ball bearing means between said insert and said outer shell.

15. The golf bag of claim 1 wherein said outer shell includes a base for supporting said golf bag on a ground surface, wherein said connector means includes a mounting plate rotatably fixed to the bottom of said insert and further comprising means for fixing said mounting plate to said base of said golf bag.

16. The golf bag of claim 15 wherein ball bearings are positioned between said mounting plate and the bottom of said insert.

17. The golf bag of claim 1 wherein said insert includes a plurality of divider means extending longitudinally from the upper portion of said insert to the lower portion of said insert.

18. The golf bag of claim 17 wherein said insert further includes top and bottom annular rings connected to said dividers.

19. The golf bag of claim 1 wherein said insert includes a top collar having divider means, a bottom collar, and a series of connector members attaching said top and bottom collars.

20. The golf bag of claim 1 wherein said insert includes a top collar having rigid dividers formed therewith, a bottom collar, a series of connector members connecting said top collar to said bottom collar, and a series of flexible dividers extending longitudinally within said insert, thereby providing a plurality of separate compartments for said golf clubs.

21. The golf bag of claim 13 wherein said support member and said retaining collar are attached to each other.

22. The golf bag of claim 4 further comprising means for restraining said insert from unwanted rotation relative to said annular support member.

23. The golf bag of claim 4 further comprising means for selectively varying the force necessary to rotate said insert relative to said annular support member.

24. The golf bag of claim 23 wherein said means for selectively varying the force includes an adjustable friction screw aligned with and cooperating with said annular mounting flange.

25. The apparatus of claim 4 further comprising bearing means between said annular support member and said mounting flange.

26. An insert system for converting an elongated golf club bag with a golf club access opening into a bag which can rotatably carry a plurality of golf clubs, the insert system comprising:

an elongated insert for receiving and holding a plurality of golf clubs, said insert being sized to fit within the access opening of the golf club bag; and connector means for attachment to the golf bag and for interconnecting said insert with the golf bag in a manner which permits said insert to rotate about its longitudinal axis relative to the golf bag, whereby the user of the converted golf bag can selectively rotate the insert so that he can easily withdraw a club from or place a club into said insert, said connector means including an annular support member for attachment to the golf bag and an annular mounting flange included on said insert, said mounting flange cooperating with and being rotatably supported on said support member.

27. The insert system of claim 26 wherein said connector means includes means for restraining said insert from moving laterally relative to said outer shell.

28. The insert system of claim 27 wherein said connector means includes means for restraining said insert from moving in a longitudinal direction into or out of said outer shell.

29. The insert system of claim 28 further comprising bearing means for facilitating rotation of said insert.

30. The insert system of claim 28 wherein said elongated insert has a substantially cylindrical shape and includes a top opening and a bottom.

31. The insert system of claim 30 further comprising divider means dividing said insert into a series of compartments to accomodate the plurality of golf clubs.

32. The insert system of claim 28 wherein said insert includes a top collar located at the top of said insert, a bottom collar located at the bottom of said insert, and a plurality of divider means extending longitudinally between and connecting said top and bottom annular collars.

33. The insert system of claim 28 wherein said elongated insert includes a top collar at the top of said insert, said top collar having divider means, a bottom collar located at the bottom of said insert, and a series of connector means attaching said top and bottom collars.

34. The insert system of claim 28 wherein said elongated insert includes a top collar having rigid dividers formed therewith, a bottom collar, a series of connector means connecting said top collar to said bottom collar, and a series of flexible dividers extending longitudinally within said insert, said flexible dividers providing a plurality of separated compartments for the golf clubs.

35. The insert system of claim 26 wherein said connector means further includes a retaining collar for retaining said mounting flange of said insert and for cooperating with said mounting flange and said support member to restrain said insert from moving in a longitudinal direction into and out of said outer shell.

36. The insert system of claim 35 wherein said annular support member further includes an annular shoulder for restraining said insert from moving laterally.

37. The insert system of claim 36 wherein said annular support member and said retaining collar are attached to one another to hold said annular mounting flange in place relative to said annular support member and said retaining collar.

38. The insert system of claim 37 further comprising bearing means between said annular support member and said annular mounting flange.

39. The insert system of claim 38 further comprising means for restraining said insert from unwanted rotation relative to said annular support member.

* * * * *